US012637178B1

(12) United States Patent
Oakes

(10) Patent No.: US 12,637,178 B1
(45) Date of Patent: May 26, 2026

(54) LIFTING DEVICE FOR BIMINI TOP FRAMES

(71) Applicant: Brian Oakes, Ocala, FL (US)

(72) Inventor: Brian Oakes, Ocala, FL (US)

( * ) Notice: Subject to any disclaimer, the term of this patent is extended or adjusted under 35 U.S.C. 154(b) by 427 days.

(21) Appl. No.: 18/222,880

(22) Filed: Jul. 17, 2023

(51) Int. Cl.
*B63B 17/02* (2006.01)
*B63B 17/00* (2006.01)

(52) U.S. Cl.
CPC ..... *B63B 17/02* (2013.01); *B63B 2017/0054* (2013.01)

(58) Field of Classification Search
CPC ..... B63B 17/02; B63B 2017/0054
USPC ..... 248/221.11
See application file for complete search history.

(56) References Cited

U.S. PATENT DOCUMENTS 1,937,954 A * 12/1933 Greene ..... A47F 8/02 223/68
2,829,660 A * 4/1958 Wester ..... B63B 17/02 114/361
2,937,652 A * 5/1960 Zimmer, Jr. ..... B63B 17/02 114/361
4,292,913 A * 10/1981 Siebert ..... B63B 59/02 267/140
4,630,982 A * 12/1986 Fenner ..... B61D 45/001 403/381
4,846,585 A * 7/1989 Boeckmann ..... B65D 33/2533 383/65
4,903,629 A * 2/1990 Maudlin ..... B63B 17/02 114/364
5,730,077 A * 3/1998 Nunes ..... B63B 59/02 114/357
6,026,761 A * 2/2000 Parniske ..... B63B 17/02 114/361
6,032,433 A * 3/2000 Hatziathanasiou ... E04H 15/646 52/63
6,267,425 B1 * 7/2001 Dorsey ..... A01K 97/08 294/143
6,269,990 B1 * 8/2001 Gray ..... A01K 97/10 224/267
7,004,100 B1 * 2/2006 Rard ..... B63B 34/26 114/364
7,162,968 B2 * 1/2007 Thompson ..... B63B 17/02 114/361
D545,671 S * 7/2007 Costa ..... D8/377
7,395,774 B2 * 7/2008 Borges ..... B63B 17/02 114/361

(Continued)

OTHER PUBLICATIONS https://web.archive.org/web/20220628113123/https://chaircaps.com/products/sbg34sf-glide-sled-base-with-superfelt.html, Chaircaps.com Jun. 28, 2022 (Year: 2022).*
ChairCaps.com (Year: 2022).*

*Primary Examiner* — Muhammad Ijaz
(74) *Attorney, Agent, or Firm* — Sanchelima & Associates, P.A.; Christian Sanchelima; Jesus Sanchelima

(57) ABSTRACT

A lifting device for bimini top frames including a lifting assembly and a support assembly. The lifting assembly includes a spacer made of rubber. The support assembly includes a layer entirely covering a bottom wall of the spacer. The spacer is attached to a bimini top frame by inserting a rod of the bimini top frame into an opening of the spacer. The opening extending a length of the top portion of the spacer. When inserted, the spacer provides a separation between the edges of the boar and the bimini top frame.

9 Claims, 3 Drawing Sheets

(56) References Cited

U.S. PATENT DOCUMENTS 7,395,775 B2 * 7/2008 LaScala ..... B63B 17/04 248/231.71
7,608,782 B2 * 10/2009 Hill ..... H01R 4/646 248/74.2
D628,050 S * 11/2010 Petersen ..... D8/356
D665,449 S * 8/2012 Guirlinger ..... D19/83
D691,032 S * 10/2013 Chen ..... D8/396
8,616,511 B2 * 12/2013 James ..... F16C 11/045 248/500
9,433,261 B1 * 9/2016 Miles ..... F16B 45/005
10,179,629 B1 * 1/2019 Henderson, III ..... B63B 17/02
10,472,022 B1 * 11/2019 Pollen ..... E04H 15/06
D881,599 S * 4/2020 Jacobs ..... D6/552
D927,284 S * 8/2021 Atalla ..... D8/323
11,479,183 B1 * 10/2022 Strayn ..... B60R 11/02
12,398,577 B2 * 8/2025 Tillman-Davis ..... E04H 15/06
2006/0090686 A1 * 5/2006 Thompson ..... B63B 17/02 114/361
2007/0096558 A1 * 5/2007 Costa ..... B63B 17/02 305/116
2013/0239872 A1 * 9/2013 Perosino ..... F16B 2/185 114/361
2015/0067991 A1 * 3/2015 Dodson ..... A01K 1/035 24/304
2018/0316150 A1 * 11/2018 Russikoff ..... H01R 39/64
2019/0032844 A1 * 1/2019 Parniske ..... G09F 9/00
2019/0077489 A1 * 3/2019 Daniel ..... F16M 13/022
2019/0100284 A1 * 4/2019 Oakes ..... F16B 5/008
2019/0223424 A1 * 7/2019 Moses ..... A47F 7/0035
2019/0246794 A1 * 8/2019 Neese ..... F16B 2/10
2020/0010159 A1 * 1/2020 Jennings ..... B63B 39/04
2020/0187477 A1 * 6/2020 Clark, Jr. ..... A01K 97/10
2021/0047003 A1 * 2/2021 Shearer ..... B63B 17/02
2023/0118942 A1 * 4/2023 Steiner ..... F16B 7/0433 114/219
2025/0075716 A1 * 3/2025 Miller ..... F01D 25/285
2025/0180063 A1 * 6/2025 Ritchey ..... F16B 43/00

* cited by examiner

LIFTING DEVICE FOR BIMINI TOP FRAMES

BACKGROUND OF THE INVENTION

1. Field of the Invention

The present invention relates to a lifting device for bimini top frames and, more particularly, to a lifting device for bimini top frames that includes a plurality of rectangular elements which can be attached to the bimini top frame so it can rest separated from the frame of the boat.

2. Description of the Related Art

Several designs for lifting devices have been designed in the past. None of them, however, include rectangular plastic elements which include apertures suitable to receive tubes of the frame of the bimini top so they can be separated from the top of the boat.

Applicant believes that a related reference corresponds to U.S. Pat. No. 8,616,511 issued for a method and apparatus for mounting a bimini top on a watercraft. Applicant believes that another related reference corresponds to U.S. Pat. No. 7,162,698 issued for a hook assembly that is used to secure a bimini top frame to a boat. None of these references, however, teach of a lifting device for bimini top frames that is comprised of a rectangular plastic spacer that is installed at various locations along a boat where a folding bimini top would normally rest, such that the frame of the bimini top is support a few inches above the boat, providing access to the boat cleats and preventing damage from the frame from rubbing against the boat.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a lifting device for bimini top frames that includes a bottom layer made of a soft material for preventing damage of the boat when the lifting member supports the bimini top.

It is another object of this invention to provide a lifting device for bimini top frames that eases the access to the boat cleats.

It is still another object of the present invention to provide a lifting device for bimini top frames capable of keeping the bimini top from rubbing and wearing the boot or sock on the top out.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
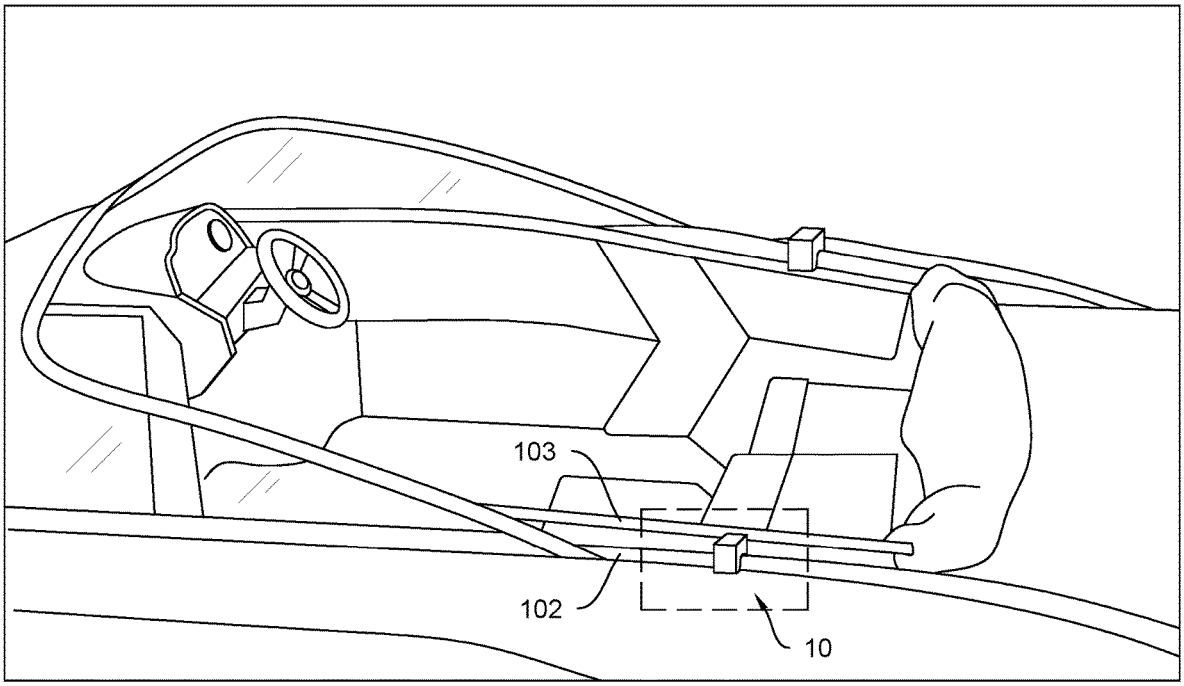
FIG. 1 represents an isometric operational view of the present invention 10.

Referring now to the drawings, where the present invention is generally referred to with numeral 10, it can be observed that it basically includes a lifting assembly 20 and a support assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
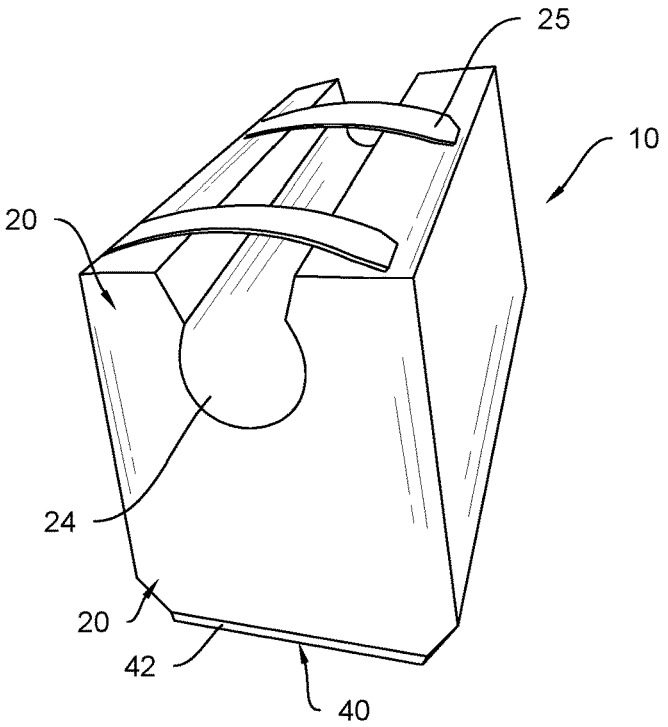
FIG. 3 illustrates an isometric view of the present invention 10. The present invention includes a lifting assembly 20 and a support assembly 40.

Referring to FIG. 3 it can be observed that the lifting assembly 20 includes a spacer 22, holders 25 and an opening 24. The spacer 22 may substantially have an irregular hexagonal elongated shape. It also may be suitable for the spacer 22 to have a rectangular shape, a circular shape, a triangular shape, or any other suitable shape. In a preferred embodiment the spacer 22 is made of rubber plastic. It also may be suitable for the spacer 22 to be made of polyurethane, fabric, or any other suitable material.

The opening 24 may extend about a length of the spacer 22. The opening 24 may extend from a front wall thereof to a rear wall thereof. The opening 24 may extend from a top of the spacer 22 to a middle portion thereof. The opening 24 may be defined by a first cutout extending diagonally downwards from the top of the spacer 22 connecting with a second cutout on a central portion of the spacer 22 having a circular shape. It also may be suitable for the opening 24 to have an oval shape, a semicircular shape or any other suitable shape.

Figure 2:
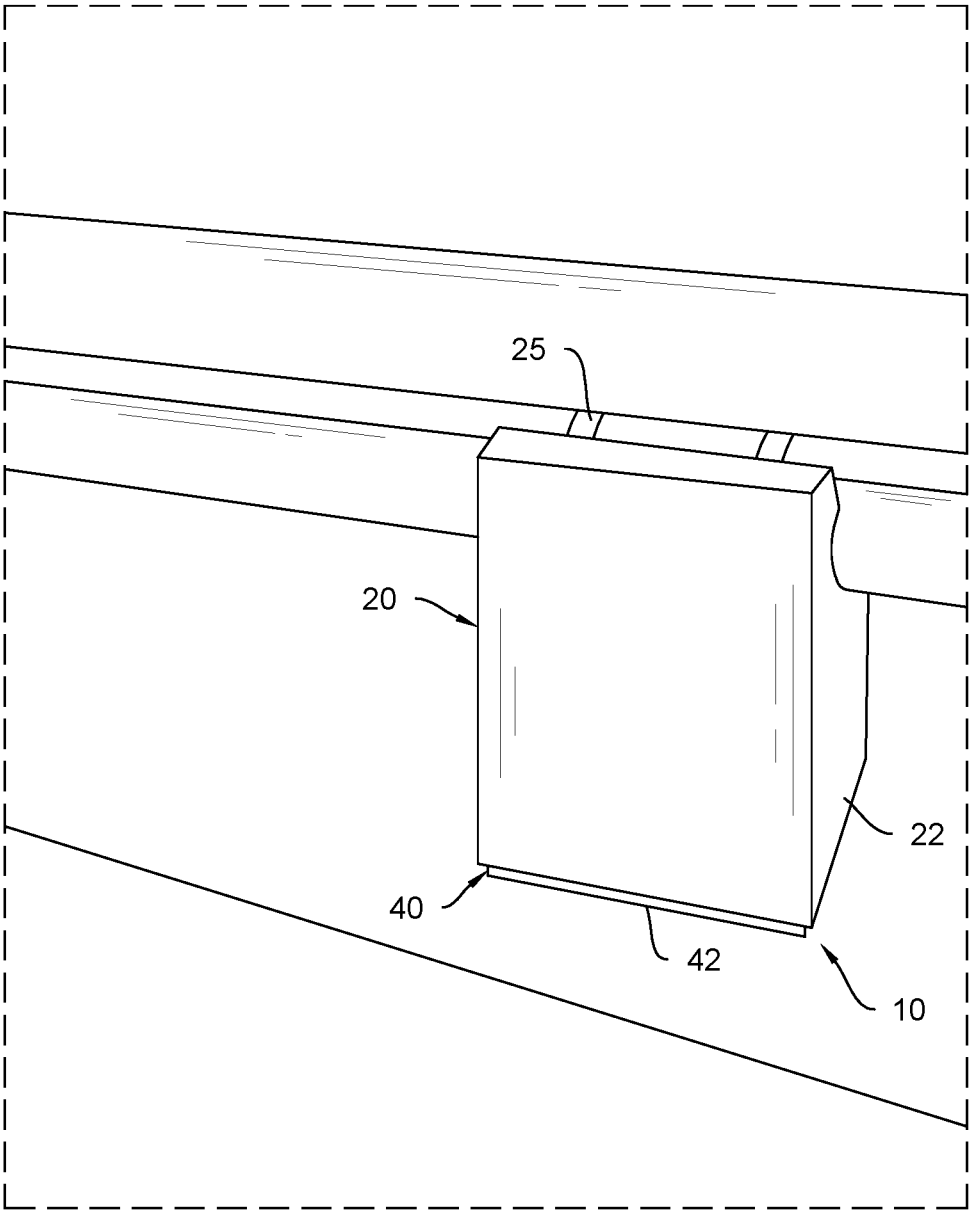
FIG. 2 shows an enlarged view of the present invention 10 in an operative environment.
Figure 2A:
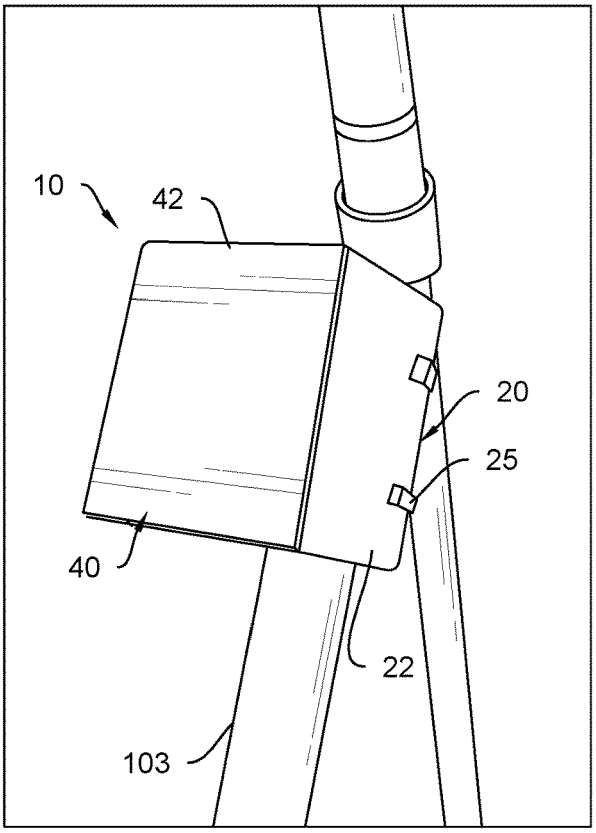
FIG. 2A depicts a rear side view of the present invention 10 attached to a tube of the bimini top frame 103 being in an expanded configuration.

As best illustrated in FIG. 2A the spacer 22 may be attached to the bimini top frame 103 by inserting the rods of the bimini top frame 103 into the opening 24. The spacer 22 may be fixed to the spacer 22 through the holders 25. In one embodiment holders 25 are security zip ties. It also may be suitable for the holders 25 to be hook and loop fasteners, or any other suitable holder.

The holders 25 may extend from a top portion of a right wall of the spacer 22 to a left wall of the spacer 22 over said opening. In a preferred embodiment the holders 25 are two holders equidistantly spaced therebetween. The holders 25 may be made of polyurethane, polyvinyl chloride, or any other suitable material.

Referring now to FIG. 2A it can be observed that the supporting assembly 40 may include layer 42. The layer 42 may extend about a rear wall of the spacer 22. The layer 42 may preferably be made of felt. It also may be suitable for the layer 42 to be made of silicone, neoprene, cotton, or any other suitable material. The layer 42 may include adherent means. In a preferred embodiment the layer 42 may be integrally formed in a bottom portion of the spacer 22.

The spacer 22 may include a bottom wall, a front wall, a rear wall, sidewalls and a partially open top wall. The bottom wall, the front wall, the rear wall and the sidewalls may be planar. It should be understood that the spacer 22 may have such dimensions that cooperate placing the present invention 10 over the edges of a boat.

It should be understood that a plurality of spacers 22 are to be attached to the bimini top frame 103 in order to provide a predetermined separation between the edges of a boat and the bimini top frame 103. In a preferred embodiment the present invention 10 may provide such separation in a retracted configuration of the bimini top 103 best illustrated in FIG. 1 and keep attached in an expanded configuration of the bimini top frame 103 best illustrated in FIG. 2A.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lifting device with a bimini top frame, comprising:

lifting assembly, wherein said lifting assembly includes a spacer having an opening; wherein said wherein said lifting assembly includes holders, said holders extending from a top-left portion of said spacer to a top-right portion of said spacer; and a layer entirely covering a bottom wall of the spacer, wherein said spacer is attached to said bimini top frame by inserting a rod of said bimini top frame into said opening, said spacer providing a separation between the edges of a boat and the bimini top frame.

2. The lifting device with the bimini top frame set forth in claim 1, wherein said opening extends a length of said spacer from a front wall of said spacer to a rear wall of said spacer.

3. The lifting device with the bimini top frame set forth in claim 2, wherein said opening extends from a top portion of said spacer to a central portion of said spacer.

4. The lifting device with the bimini top frame set forth in claim 1, wherein said opening is defined by a first cutout extending diagonally downwards from a top wall of the spacer to a second cutout having a circular shape.

5. The lifting device with the bimini top frames set forth in claim 1, wherein said holders are security zip ties.

6. The lifting device with the bimini top frame set forth in claim 1, wherein said holders are two holders equidistantly disposed, said holders are configured to fix said spacer to said bimini top frame.

7. The lifting device with the bimini top frame set forth in claim 1, wherein said layer is made of felt.

8. A lifting device with a bimini top frame, comprising:

lifting assembly, wherein said lifting assembly includes a spacer having an opening and holders, wherein said opening extends a length of said spacer from a front wall of said spacer to a rear wall of said spacer and from a top portion of said spacer to a central portion of said spacer, wherein said holders extend from a top-left portion of said spacer to a top-right portion of said spacer, wherein said opening is defined by a first cutout extending diagonally downwards from a top wall of the spacer to a second cutout having a circular shape; and a layer entirely covering a bottom wall of the spacer, wherein said spacer is attached to a bimini top frame by inserting a rod of said bimini top frame into said opening, said spacer providing a separation between the edges of a boat and the bimini top frame.

9. A lifting device with a bimini top frame, consisting of:

lifting assembly, wherein said lifting assembly includes a spacer having an opening and holders, wherein said opening extends a length of said spacer from a front wall of said spacer to a rear wall of said spacer and from a top portion of said spacer to a central portion of said spacer, wherein said holders extend from a top-left portion of said spacer to a top-right portion of said spacer, wherein said holders are two holders equidistantly disposed, said holders are configured to fix said spacer to said bimini top frame; and a layer entirely covering a bottom wall of the spacer, wherein said spacer is attached to a bimini top frame by inserting a rod of said bimini top frame into said opening, said spacer providing a separation between the edges of a boat and the bimini top frame, wherein said layer is made of felt.

* * * * *